United States Patent [19]

Herd

[11] Patent Number: 5,044,300

[45] Date of Patent: Sep. 3, 1991

[54] BARRIER WRAPPER

[76] Inventor: Douglas M. Herd, #1021 Toronto Dominion Tower, Edmonton Center, Edmonton, Alberta T5J 2Z1, Canada

[21] Appl. No.: 523,708

[22] Filed: Apr. 18, 1990

[30] Foreign Application Priority Data

Dec. 15, 1989 [CA] Canada ..... 2005674

[51] Int. Cl.[5] ..... E01F 13/00; G09F 7/12

[52] U.S. Cl. ..... 116/63 R; 49/49; 40/611

[58] Field of Search ..... 116/63 R; 40/611, 612, 40/582, 594; 256/13.1; 49/49; 229/87.01

[56] References Cited

U.S. PATENT DOCUMENTS

| | | | |
|---|---|---|---|
| 2,032,386 | 3/1936 | Wood | 229/87.01 |
| 2,354,018 | 7/1944 | Heltzer et al. | 40/582 |
| 2,481,757 | 9/1949 | Jungersen | 40/582 |
| 2,775,397 | 12/1956 | Vogt | 229/87.01 |
| 2,997,978 | 8/1961 | Clutter | 116/63 P |
| 3,628,721 | 12/1971 | Palmer | 229/87.01 |
| 3,950,873 | 4/1976 | Stehle et al. | 40/612 |
| 4,312,600 | 1/1982 | Schaaf et al. | 40/612 |
| 4,318,079 | 3/1982 | Dickinson | 49/49 |
| 4,364,200 | 12/1982 | Cobb | 49/49 |
| 4,544,586 | 10/1985 | Molari, Jr. | 40/612 |
| 4,636,108 | 1/1987 | Duckett | 116/63 R |
| 4,655,002 | 4/1987 | Everson | 49/49 |
| 4,681,479 | 7/1987 | Wagner et al. | 49/49 |
| 4,811,516 | 3/1989 | Anderson | 49/49 |

FOREIGN PATENT DOCUMENTS

| | | | |
|---|---|---|---|
| 0483816 | 6/1952 | Canada | 40/612 |
| 1266784 | 4/1968 | Fed. Rep. of Germany | 116/63 P |
| 1105417 | 3/1968 | United Kingdom | 116/63 C |

*Primary Examiner*—William A. Cuchlinski, Jr.
*Assistant Examiner*—John L. Beres
*Attorney, Agent, or Firm*—Dressler, Goldsmith, Shore, Sutker & Milnamow, Ltd.

[57] ABSTRACT

A wrapper for parking area gates or construction barriers is disclosed. The unique wrapper consists of an elongate piece of flexible generally paper-like material of sufficient length and width to wrap around a barrier arm. Indicia of diagonally spaced blocks of contrasting colours are affixed to the wrapper in a parallel manner. When a barrier member is replaced, the covering is wrapped about the barrier member and secured to itself thereby producing instantly a new barrier for re-operation of the parking area or protection of the construction site. The invention eliminates the cost of expensive cuts of wood and meticulous painting each time the barrier is broken.

2 Claims, 1 Drawing Sheet

BARRIER WRAPPER

FIELD OF THE INVENTION

This invention relates to barriers for parking garages and construction sites and more particularly relates to gate arms for entrance and exit barriers.

In recent years, parking lots and garages have greatly increased in numbers in the world's cities. In addition the number of construction sites in busy downtown locations have increased.

The most common equipment for such garages is a gate barrier at the entrance and a second barrier at the exit. In some situations, a permit holder inserts a card into a machine to enter and to exit the garage or construction site. In public parking situations, entrance to the garage or parking area is obtained automatically by pressing a button which dispenses a ticket to the driver thereupon raising the gate to allow the entry of one vehicle.

BACKGROUND OF THE INVENTION

The gates must be sufficiently strong to avoid illegal unauthorized entry and exit while also being sufficiently breakable to avoid serious damage to a vehicle during accidental unauthorized entry or exit.

Because of driver error or vehicle failure, thousands or tens of thousands of such barriers are broken annually, whether by accident or illegal entry. Each time such a barrier gate is broken, it is necessary to remove the gate and allow entry to all, or to man the entry by means of a human person, during repair and replacement of the gate member. Obviously each time there is breakage a financial burden is imposed upon the owner of the parking garage one way or another.

In a similar manner barriers around construction sites are often broken by heavy machinery or construction materials.

Therefore, the quickest and least expensive repair to such a barrier gate is to the benefit of the owner.

In the present art, it is necessary to unbolt or release the wooden gate arm from the associate machinery and replace it with a new piece of wood. In order that the gate or barrier be clearly visible to all, it is necessary to paint the new wooden gate arm with coloured diagonal stripes. Boards suitable for such a gate arm must be of fairly high quality wood in order that the painting of the indicia will be clear and even.

Presently, some operators purchase their own boards and have an attendant of the parking area paint the barrier with the required indicia. Other operators, in order to avoid labour cost, simply purchase made-to-order gate arms painted and ready to install. In either case, the replacement of the barrier arm monthly or even weekly basis, in heavily congested areas is costly and time-consuming.

It is therefore an object of the present invention to provide a means to quickly replace a barrier in an inexpensive manner.

It is a further object of this invention to provide a product which will eliminate the need for expensive cuts of wood and costly painting.

SUMMARY OF THE INVENTION

These objects are accomplished by using a pre-made flexible covering which is pre-coated with indicia and which is used to envelop an ordinary board suitable for a gate arm, or a construction barrier.

Therefore, this invention seeks to provide on a barrier for use with parking facilities or construction sites, a wrapper comprising an elongate sheet of flexible material dimensioned to form a sleeve when in place on a barrier arm;

said wrapper carrying indicia on an external surface; and said indicia being adapted to visually exaggerate the arm when encased in the wrapping.

This invention further seeks to provide a covering for a barrier member comprising an elongate sheet of flexible material comprising: at least one adhesive surface on one side thereof and bearing at least one strip of indicia adapted to exaggerate the visual appearance of said barrier; said sheet of material being adapted to wrap around said barrier member and be secured upon itself.

The present invention is simple, but effective. Generally, an elongate piece of flexible material such as high grade water repellant paper is used.

In a preferred embodiment, the elongate piece of paper is sufficiently wide to completely wrap around boards of varying widths and thicknesses. A glue strip is applied along one side of the wrapper so that it can be folded and secured to the opposite side. The wrapper is equipped with two strips of indicia which extend throughout the length of the covering. These are usually placed in such a position that when the covering is secured to the gate member, one strip of indicia is located on each face of the gate member. The indicia can be incorporated directly into the manufacture of the wrapper or can be in the form of glue strips or decals which are applied to the covering. The covering can also be made of good quality plastic sheeting or other suitable weatherproof material, such as boxboard or other relatively flexible paper product.

The invention may also be manufactured in rolls of several metres having a predetermined width of twenty to thirty inches. The strips of indicia would run with the length of the roll. The owner or operator of a parking garage or construction site can unroll and cut off a piece of sufficient length for the new barrier and quickly apply it to the new gate arm. In this manner, an operator will always have new covering on hand.

BRIEF DESCRIPTION OF THE DRAWINGS

The invention will be described in greater detail in conjunction with the following drawings, wherein.

DETAILED DESCRIPTION OF THE INVENTION

Figure 1:
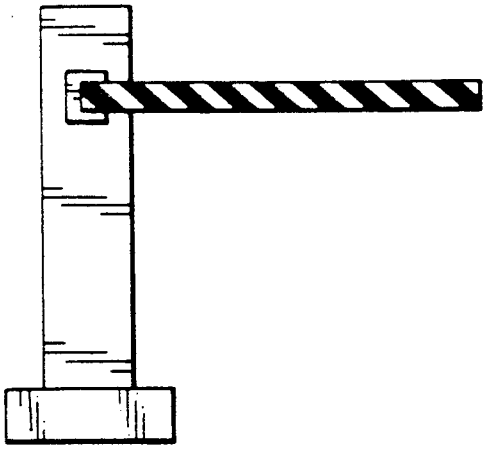
(PRIOR ART) FIG. 1
FIG. 1 is a prior art barrier.

In FIG. 1, one notes a standard parking gate. A piece of wood is painted with indicia which encircle the gate arm.

Figure 2:
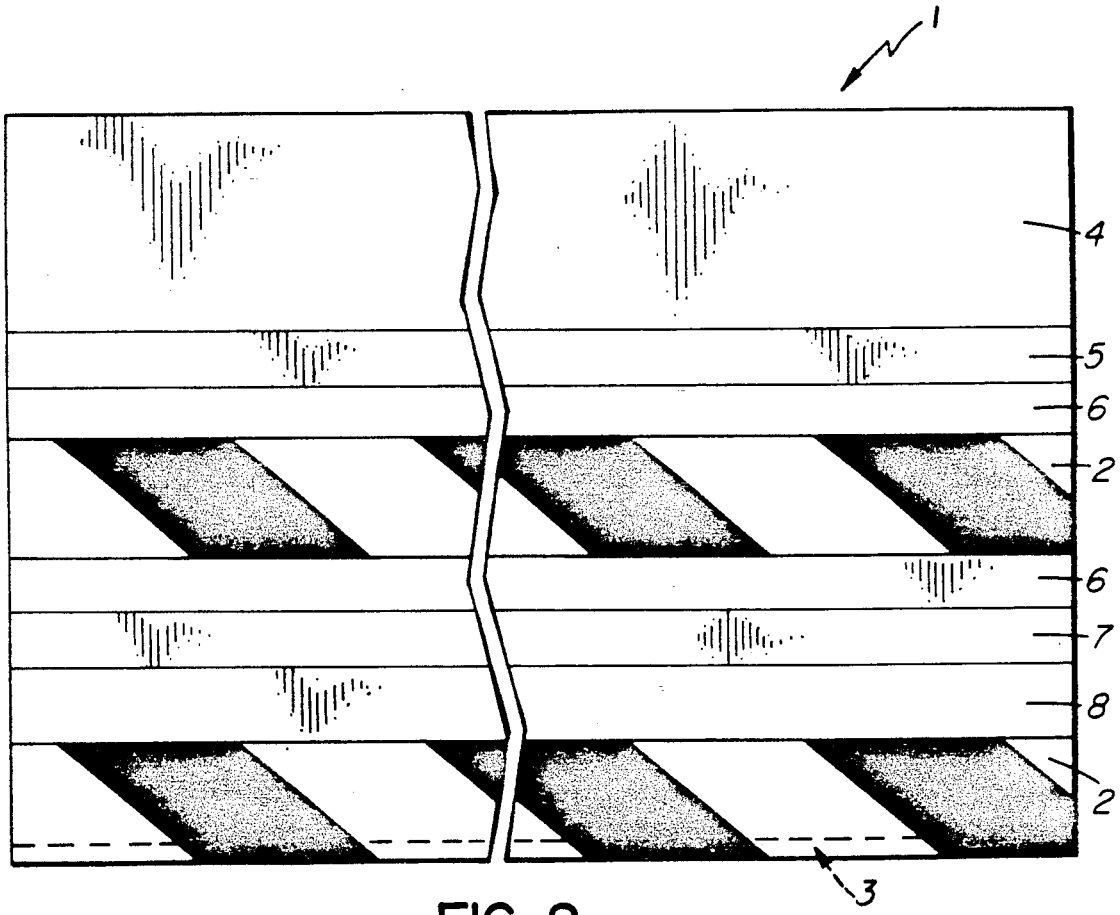
FIG. 2 is a face view of the present invention in the unfolded state.

FIG. 2 is a face view of the present invention in an unfolded state, comprising the covering 1, strips of indicia 2 and a glue strip 3. In order to apply the covering to a gate arm, the portion marked 4 is applied to the front face of the gate; the area marked 5 is folded along the bottom of the gate arm; area 6 is turned upwards and applied to the rear face of the gate arm; area 7 folds over the top of the gate arm, and area 8 is applied against area 4 and the glue strip 3 applied along a portion of area 4 or 5, depending on the thickness and width of the new gate arm.

Figure 3:
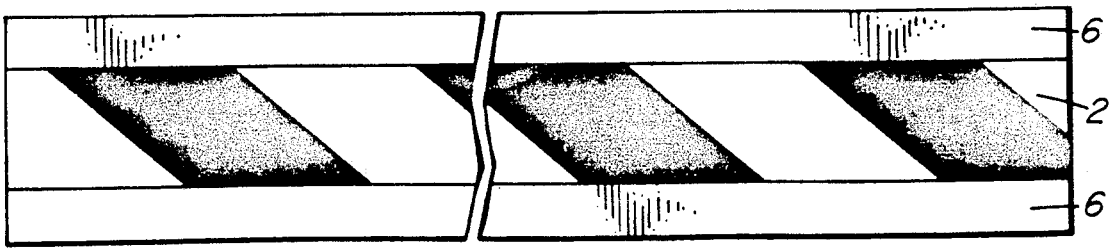
FIG. 3 is a perspective view of the present invention when wrapped in an enveloped state around a gate arm.

FIG. 3 is a perspective view of a gate arm with a wrapper of the present invention mounted thereon.

The invention is not limited to the particular embodiment shown herein, but rather encompasses any variation or extension of the basic concept.

What I claim as my invention is:

1. A replaceable wrapper for an elongate wooden gate arm for use with the entrance and exit ways of parking facilities, comprising an elongate sheet of flexible material dimensioned to form a single elongate sleeve adapted to encase said elongate wooden gate arm;

said wrapper carrying two sets of a plurality of oblique lined indicia positioned on said flexible material such that when said wrapper is applied to said arm, said indicia visually exaggerate the front and rear faces of said arm;

wherein said flexible material is paper, and said two sets of a plurality of oblique lined indicia are diagonally arranged coloured bands comprising two glue strips.

2. A replaceable wrapper for an elongate wooden gate arm for use with the entrance and exit ways of parking facilities, comprising an elongate sheet of flexible material dimensioned to form a single elongate sleeve adapted to encase said elongate wooden gate arm;

said wrapper carrying two sets of a plurality of oblique lined indicia positioned on said flexible material such that when said wrapper is applied to said arm, said indicia visually exaggerate the front and rear faces of said arm;

said wrapper further comprising at least one adhesive surface on one side of said flexible material;

said sheet of flexible material being adapted to wrap around said elongate wooden gate arm and be secured upon itself.

* * * * *